US005728658A

United States Patent [19]

Duncan

[11] Patent Number: 5,728,658

[45] Date of Patent: Mar. 17, 1998

[54] BIODEGRADABLE SYNTHETIC ESTER BASE STOCKS FORMED FROM BRANCHED OXO ACIDS

[75] Inventor: Carolyn Boggus Duncan, Baton Rouge, La.

[73] Assignee: Exxon Chemical Patents Inc, Houston, Tex.

[21] Appl. No.: 652,012

[22] Filed: May 21, 1996

[51] Int. Cl.$^6$ ..... C10M 105/38

[52] U.S. Cl. ..... 508/485; 560/263

[58] Field of Search ..... 508/485; 560/263

[56] References Cited

U.S. PATENT DOCUMENTS

| | | | |
|---|---|---|---|
| 3,360,465 | 12/1967 | Warman | 252/56 |
| 4,263,159 | 4/1981 | Berent et al. | 252/79 |
| 4,382,002 | 5/1983 | Walker et al. | 252/8.5 C |
| 4,392,967 | 7/1983 | Alexander | 252/41 |
| 4,440,657 | 4/1984 | Metrl et al. | 252/49.9 |
| 4,663,479 | 5/1987 | Velenyi et al. | 562/525 |
| 4,783,274 | 11/1988 | Jokinen et al. | 252/32.7 |
| 4,826,633 | 5/1989 | Carr et al. | 252/56 S |
| 5,057,247 | 10/1991 | Schmid et al. | 252/56 S |
| 5,156,759 | 10/1992 | Culpon, Jr. | 252/56 R |
| 5,308,524 | 5/1994 | Miyaji et al. | 252/51.5 A |
| 5,330,667 | 7/1994 | Tiffany, III et al. | 252/49.6 |
| 5,458,794 | 10/1995 | Bardasz et al. | 508/485 |
| 5,463,137 | 10/1995 | Ramachandran | 568/454 |
| 5,503,761 | 4/1996 | Ashcraft, Jr. et al. | 508/485 |

FOREIGN PATENT DOCUMENTS

| | | | |
|---|---|---|---|
| 0 406 479 | 1/1991 | European Pat. Off. | C10M 105/38 |
| 0 435 253 | 7/1991 | European Pat. Off. | C10M 105/36 |
| 0 498 152 | 8/1992 | European Pat. Off. | C10M 171/00 |
| 0 612 832 | 12/1993 | European Pat. Off. | C10M 105/40 |
| 4-120195 | 4/1992 | Japan | C10M 169/04 |
| 1441918 | 7/1976 | United Kingdom . | |
| 93/11210 | 6/1993 | WIPO | C10M 171/00 |

OTHER PUBLICATIONS

Waal and Kenbeek, "Testing, Application, and Future Development of Environmentally Friendly Ester Base Fluids", Journal of Synthetic Lubrication, vol. 10, No. 1, Apr. 1993, pp. 67–83.

*Primary Examiner*—Jacqueline V. Howard
*Attorney, Agent, or Firm*—Richard D. Jordan

[57] ABSTRACT

A biodegradable lubricant which is prepared from: about 60–99% by weight of at least one biodegradable synthetic ester base stock which comprises the reaction product of: a branched or linear alcohol having the general formula $R(OH)_n$, wherein R is an aliphatic or cyclo-aliphatic group having from about 2 to 20 carbon atoms and n is at least 2; and at least one branched oxo acid having a carbon number in the range between about $C_5$ to $C_{10}$, provided that said branched oxo acid does not include 2-ethylhexanoic acid; wherein the ester base stock exhibits the following properties: at least 60% biodegradation in 28 days as measured by the Modified Sturm test; a pour point of less than −25° C.; and a viscosity of less than 7500 cps at −25° C.; about 1 to 20% by weight lubricant additive package; and about 0 to 20% of a solvent.

36 Claims, 3 Drawing Sheets

BIODEGRADABLE SYNTHETIC ESTER BASE STOCKS FORMED FROM BRANCHED OXO ACIDS

The present invention relates generally to the use of branched synthetic esters to improve the cold-flow properties and dispersant solubility of biodegradable lubricant base stocks without loss of biodegradation or lubrication. At least 60% biodegradation (as measured by the Modified Sturm test) can be achieved by means of esterifying a polyol (e.g., a trimethylol propane (TMP) or neopentyl glycol (NPG) with a branched oxo acid, provided that 2-ethylhexanoic acid is excluded from the oxo acids. These branched synthetic esters are particularly useful in the formation of biodegradable lubricants in two-cycle engine oils, catapult oils, hydraulic fluids, drilling fluids, water turbine oils, gear oils, greases, compressor oils, and other industrial and engine applications where biodegradability is needed or desired.

BACKGROUND OF THE INVENTION

The interest in developing biodegradable lubricants for use in applications which result in the dispersion of such lubricants into waterways, such as rivers, oceans and lakes, has generated substantial interest by both the environmental community and lubricant manufacturers. The synthesis of a lubricant which maintains its cold-flow properties and additive solubility without loss of biodegradation or lubrication would be highly desirable.

Base stocks for biodegradable lubricant applications (e.g., two-cycle engine oils, catapult oils, hydraulic fluids, drilling fluids, water turbine oils, gear oils, greases and compressor oils) should typically meet five criteria: (1) solubility with dispersants and other additives such as polyamides; (2) good cold flow properties (such as, less than −40° C. pour point; less than 7500 cps at −25° C.); (3) sufficient biodegradability to off-set the low biodegradability of any dispersants and/or other additives to the formulated lubricant; (4) good lubricity without the aid of wear additives; and (5) high flash point (greater than 175° C., flash and fire points by COC (Cleveland Open Cup) as measured by ASTM test number D-92).

The Organization for Economic Cooperation and Development (OECD) issued draft test guidelines for degradation and accumulation testing in December 1979. The Expert Group recommended that the following tests should be used to determine the "ready biodegradability" of organic chemicals: Modified OECD Screening Test, Modified MITI Test (I), Closed Bottle Test, Modified Sturm Test and the Modified AFNOR Test. The Group also recommended that the following "pass levels" of biodegradation, obtained within 28 days, may be regarded as good evidence of "ready biodegradability": (Dissolved Organic Carbon (DOC)) 70%; (Biological Oxygen Demand (BOD)) 60%; (Total Organic Carbon (TOD)) 60%; ($CO_2$) 60%; and (DOC) 70%, respectively, for the tests listed above. Therefore, the "pass level" of biodegradation, obtained within 28 days, using the Modified Sturm Test is at least ($CO_2$) 60%.

The OECD guideline for testing the "ready biodegradability" of chemicals under the Modified Sturm test (OECD 301B, adopted May 12, 1981, and which is incorporated herein by reference) involves the measurement of the amount of $CO_2$ produced by the test compound which is measured and expressed as a percent of the theoretical $CO_2$($TCO_2$) it should have produced calculated from the carbon content of the test compound. Biodegradability is therefore expressed as a percentage of $TCO_2$. The Modified Sturm test is run by spiking a chemically defined liquid medium, essentially free of other organic carbon sources, with the test material and inoculated with sewage microorganisms. The $CO_2$ released is trapped as $BaCO_3$. After reference to suitable blank controls, the total amount of $CO_2$ produced by the test compound is determined for the test period and calculated as the percentage of total $CO_2$ that the test material could have theoretically produced based on carbon composition. See G. van der Waal and D. Kenbeek, "Testing, Application, and Future Development of Environmentally Friendly Ester Based Fluids", *Journal of Synthetic Lubrication*, Vol. 10, Issue No. 1, April 1993, pp. 67–83, which is incorporated herein by reference.

One base stock in current use today is rapeseed oil (i.e., a triglyceride of fatty acids, e.g., 7% saturated $C_{12}$ to $C_{18}$ acids, 50% oleic acid, 36% linoleic acid and 7% linolenic acid, having the following properties: a viscosity at 40° C. of 47.8 cSt, a pour point of 0° C., a flash point of 162° C. and a biodegradability of 85% by the Modified Sturm test. Although it has very good biodegradability, its use in biodegradable lubricant applications is limited due to its poor low temperature properties and poor stability.

Unless they are sufficiently low in molecular weight, esters synthesized from both linear acids and linear alcohols tend to have poor low temperature properties. Even when synthesized from linear acids and highly branched alcohols, such as polyol esters of linear acids, high viscosity esters with good low temperature properties can be difficult to achieve. In addition, pentaerythritol esters of linear acids exhibit poor solubility with dispersants such as polyamides, and trimethylol propane esters of low molecular weight (i.e., having a carbon number less than 14) linear acids do not provide sufficient lubricity. This lower quality of lubricity is also seen with adipate esters of branched alcohols. Since low molecular weight linear esters also have low viscosities, some degree of branching is required to build viscosity while maintaining good cold flow properties. Conventional wisdom believed that when both the alcohol and acid portions of the ester are highly branched, such as with the case of polyol esters of highly branched acids, the resulting molecule would exhibit poor biodegradation as measured by the Modified Sturm test (OECD Test No. 301B).

In an article by Randles and Wright, "Environmentally Considerate Ester Lubricants for the Automotive and Engineering Industries", *Journal of Synthetic Lubrication*, Vol. 9-2, pp. 145–161, it was stated that the main features which slow or reduce microbial breakdown are the extent of branching, which reduces β-oxidation, and the degree to which ester hydrolysis is inhibited. The negative effect on biodegradability due to branching along the carbon chain is further discussed in a book by R. D. Swisher, "Surfactant Biodegradation", *Marcel Dekker, Inc.*, Second Edition, 1987, pp. 415–417. In his book, Swisher stated that "The results clearly showed increased resistance to biodegradation with increased branching . . . . Although the effect of a single methyl branch in an otherwise linear molecule is barely noticeable, increased resistance [to biodegradation] with increased branching is generally observed, and resistance becomes exceptionally great when quaternary branching occurs at all chain ends in the molecule." The negative effect of alkyl branching on biodegradability was also discussed in an article by N. S. Battersby, S. E. Pack, and R. J. Watkinson, "*A Correlation Between the Biodegradability of Oil Products in the CEC-L-33-T-82 and Modified Sturm Tests*", Chemosphere, 24(12), pp. 1989–2000 (1992).

Initially, the poor biodegradation of branched polyol esters was believed to be a consequence of the branching and, to a lesser extent, to the insolubility of the molecule in water. However, recent work by the present inventor, as disclosed in co-pending and commonly assigned U.S. patent application Ser. No. 08/351,990, filed on Dec. 8, 1994, which is incorporated herein by reference, has shown that the non-biodegradability of these branched esters is more a function of steric hindrance than of the micro-organism's inability to breakdown the tertiary and quaternary carbons. Thus, by relieving the steric hindrance around the ester linkage(s), biodegradation can more readily occur with branched esters.

Branched synthetic polyol esters have been used extensively in non-biodegradable applications, such as refrigeration lubricant applications, and have proven to be quite effective if 3,5,5-trimethylhexanoic acid is incorporated into the molecule at 25 molar percent or greater. However, trimethylhexanoic acid is not biodegradable as determined by the Modified Sturm test (OECD 301B), and the incorporation of 3,5,5-trimethylhexanoic acid, even at 25 molar percent, would drastically lower the biodegradation of the polyol ester due to the quaternary carbons contained therein.

Likewise, incorporation of trialkyl acetic acids (i.e., neo acids) into a polyol ester produces very useful refrigeration lubricants. These acids do not, however, biodegrade as determined by the Modified Sturm test (OECD 301B) and cannot be used to produce polyol esters for biodegradable applications. Polyol esters of all branched acids have been used as refrigeration oils as well. However, it was believed that they would not rapidly biodegrade as determined by the Modified Sturm Test (OECD 301B) and, therefore, would not be desirable for use in biodegradable applications.

Although polyol esters made from purely linear $C_5$ and $C_{10}$ acids for refrigeration applications would be biodegradable under the Modified Sturm test, they would not work as a lubricant in hydraulic or two-cycle engine applications because the viscosities would be too low. It is extremely difficult to develop a lubricant base stock which is capable of exhibiting all of the various properties required for biodegradable lubricant applications, i.e., high viscosity, low pour point, oxidative stability and biodegradability as measured by the Modified Sturm test.

U.S. Pat. No. 4,826,633 (Carr et al.), which issued on May 2, 1989, discloses a synthetic ester lubricant base stock formed by reacting at least one of trimethylol propane and monopentaerythritol with a mixture of aliphatic monocarboxylic acids. The mixture of acids includes straight-chain acids having from 5 to 10 carbon atoms and an iso-acid having from 6 to 10 carbon atoms, preferably iso-nonanoic acid (i.e., 3,5,5-trimethylhexanoic acid). This base stock is mixed with a conventional ester lubricant additive package to form a lubricant having a viscosity at 99° C. (210° F.) of at least 5.0 centistokes and a pour point of at least as low as −54° C. (−65° F.). This lubricant is particularly useful in gas turbine engines. The Carr et al. patent differs from the present invention for two reasons. Firstly, it preferably uses as its branched acid 3,5,5-trimethylhexanoic acid which contains a quaternary carbon in every acid molecule. The incorporation of quaternary carbons within the 3,5,5-trimethylhexanoic acid inhibits biodegradation of the polyol ester product. Also, since the lubricant according to Carr et al. exhibits high stability, as measured by a high pressure differential scanning calorimeter (HPDSC), i.e., about 35 to 65 minutes, the micro-organisms cannot pull them apart.

Therefore, the present inventor has discovered that highly biodegradable lubricants using biodegradable base stocks with good cold flow properties, good solubility with dispersants, and good lubricity can be achieved by forming an ester base stock from a polyol (e.g., TMP or NPG) and a branched oxo acid having a carbon number in the range between about 5 to 10, preferably 7 to 10; provided that 2-ethylhexanoic acid is excluded from the group of oxo acids. The branched oxo acids used in accordance with the present invention are needed to build viscosity and the multiple isomers in these acids are helpful in attaining low temperature properties. That is, the branched oxo acids allow the chemist to build viscosity without increasing molecular weight. Furthermore, branched biodegradable lubricants provide the following cumulative advantages over all linear biodegradable lubricants: (1) decreased pour point; (2) increased solubilities of other additives; and (3) increased detergency/dispersancy of the lubricant oil.

The data compiled by the present inventor and set forth in the examples to follow show that biodegradable synthetic esters can be formed from all branched reactants such as TMP and iso-oxo octanoic acid (e.g., Cekanoic®8).

To the contrary, the present inventor has discovered that if the acid is predominantly branched on the α-carbon to the carbonyl carbon, such as 2-ethylhexanoic (2EH) acid, then the steric hindrance becomes too great for enzymatic attack. Thus, not all branched acids will produce a polyol ester having acceptable biodegradability.

Accordingly, the present invention involves the synthesis of a biodegradable synthetic ester base stock by the esterification of a polyol with a branched acid form from the oxo process. The oxo process promotes the formation of branched acids whose branching is along the chain with very little branching on the α-carbon to the carbonyl carbon. Because the branching of the oxo acid is away from the ester linkages, i.e., at the beta-carbon or higher to the carbonyl carbon, enzymatic cleavage of the linkage can occur.

SUMMARY OF THE INVENTION

A biodegradable synthetic base stock which preferably comprises the reaction product of a branched or linear alcohol having the general formula $R(OH)_n$, wherein R is an aliphatic or cyclo-aliphatic group having from about 2 to 20 carbon atoms (preferably an alkyl) and n is at least 2 and up to about 10; and a branched oxo acid having a carbon number (i.e., carbon number means the total number of carbon atoms in either the acid or alcohol as the case may be) in the range between about $C_5$ to $C_{10}$, more preferably $C_7$ to $C_{10}$, provided that the oxo acid does not include any significant amount of oxo acid isomers having branching at the α-carbon to the carbonyl carbon (e.g., 2-ethylhexanoic acid), and wherein no more than 10% of said branched acids used to form the biodegradable synthetic ester base stock contains a quaternary carbon, wherein the ester exhibits the following properties: at least 60% biodegradation in 28 days as measured by the Modified Sturm test; a pour point of less than −40° C.; and a viscosity of less than 7500 cps at −25° C. Moreover, the ester base stock preferably exhibits a high flash point COC of at least 175° C.

In the most preferred embodiment, it is desirable to have a branched acid comprising multiple isomers, preferably more than 3 isomers, most preferably more than 5 isomers.

The branched or linear alcohol is selected from the group consisting of: neopentyl glycol, trimethylol propane, ethylene or propylene glycol, butane diol, sorbitol, and 2-methylpropane diol.

The branched oxo acid has an average branching per molecule in the range between about 0.3 to 1.9 with the branching preferably on the beta-carbon to the carbonyl carbon or higher. The branched oxo acid is preferably at least one acid selected from the group consisting of: iso-pentanoic acid, iso-hexanoic acid, iso-heptanoic acids, iso-octanoic acids, iso-nonanoic acids, and iso-decanoic acids; provided that the iso-nonanoic acid is not 3,5,5-trimethylhexanoic acid due to the presence of quaternary carbons.

The biodegradable lubricant may also be a blend of the branched synthetic ester disclosed immediately above and at least one ester selected from the group consisting of: naturally occurring oils (e.g., rapeseed oil) and other biodegradable synthetic esters.

These biodegradable synthetic base stocks are particularly useful in the formulation of biodegradable lubricants, such as, two-cycle engine oils, biodegradable catapult oils, biodegradable hydraulic fluids, biodegradable drilling fluids, biodegradable water turbine oils, biodegradable greases, biodegradable compressor oils, biodegradable gear oils, functional fluids and other industrial and engine applications where biodegradability is needed or desired.

The formulated biodegradable lubricants according to the present invention preferably comprise about 60–99% by weight of at least one biodegradable lubricant synthetic base stock discussed above, about 1 to 20% by weight lubricant additive package, and about 0 to 20% of a solvent.

DESCRIPTION OF THE PREFERRED EMBODIMENTS

Figure 1:
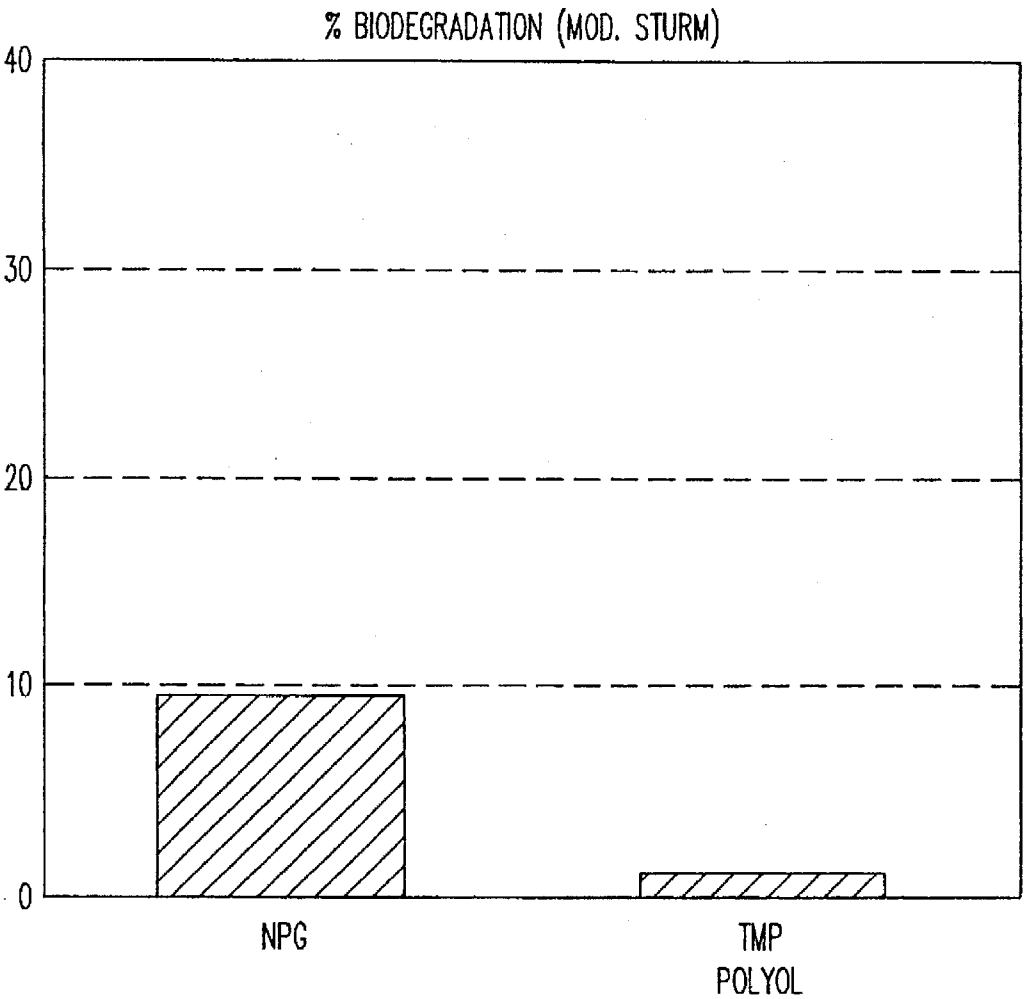
FIG. 1 is a graph plotting percent biodegradation (Modified Sturm Test) versus neopentyl glycol and trimethylol propane.
Figure 2:
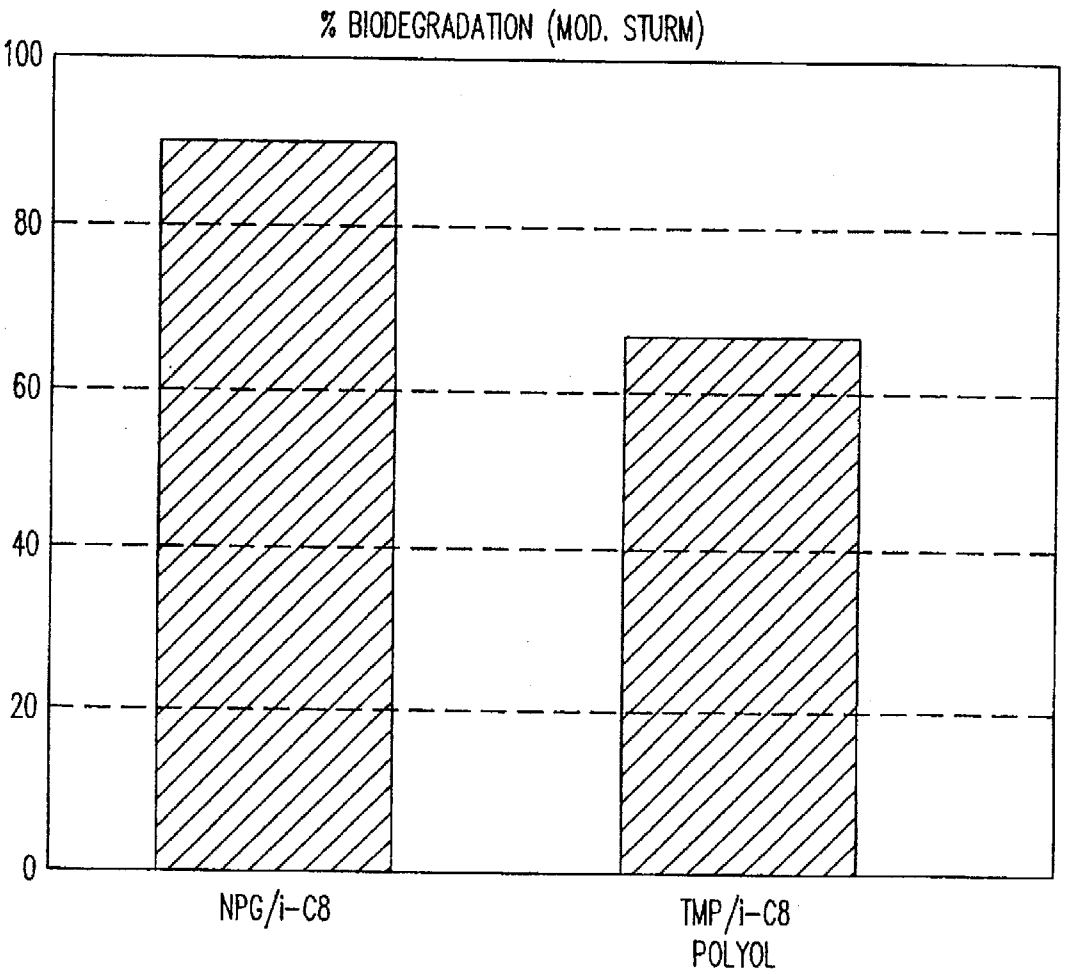
FIG. 2 is a graph plotting percent biodegradation (Modified Sturm Test) versus various synthetic polyol esters formed from Cekanoic 8.

The branched synthetic ester base stock used in the formulation of various biodegradable lubricants and oils in accordance with the present invention is preferably formed from the reaction product of a polyol ester and a branched $C_5$ to $C_{10}$ oxo acid, e.g., iso-oxo octanoic acid (Cekanoic®8).

ALCOHOLS

Among the alcohols which can be reacted with the branched and linear acids of the present invention are, by way of example, polyols (i.e., polyhydroxyl compounds) represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally will contain from about 2 to about 10 hydroxyl groups and more preferably from about 2 to about 6 hydroxy groups. The polyhydroxy compound may contain one or more oxyalkylene groups and, thus, the polyhydroxy compounds include compounds such as polyetherpolyols. The number of carbon atoms (i.e., carbon number) and number of hydroxy groups (i.e., hydroxyl number) contained in the polyhydroxy compound used to form the carboxylic esters may vary over a wide range.

The following alcohols are particularly useful as polyols: neopentyl glycol, 2,2-dimethylol butane, trimethylol ethane, trimethylol propane, trimethylol butane, ethylene glycol, propylene glycol and polyalkylene glycols (e.g., polyethylene glycols, polypropylene glycols, polybutylene glycols, etc., and blends thereof such as a polymerized mixture of ethylene glycol and propylene glycol).

The preferred branched or linear alcohols are selected from the group consisting of: neopentyl glycol, trimethylol propane, trimethylol ethane and propylene glycol, 1,4-butanediol, sorbitol and the like, and 2-methylpropanediol. The most preferred alcohols are trimethylol propane and neopentyl glycol.

BRANCHED OXO ACIDS

The branched oxo acid is preferably a mono-carboxylic oxo acid which has a carbon number in the range between about $C_5$ to $C_{10}$, preferably $C_7$ to $C_{10}$, wherein methyl branches are preferred. The preferred branched oxo acids are those wherein less than or equal to 10% of the branched acids contain a quaternary carbon. The mono-carboxylic oxo acid is at least one acid selected from the group consisting of: iso-pentanoic acids, iso-hexanoic acids, iso-heptanoic acids, iso-octanoic acids, iso-nonanoic acids, and iso-decanoic acids; provided that predominantly α-carbon to the carbonyl carbon branched oxo acids such as 2-ethylhexanoic acid (2EH) are specifically excluded from the branched oxo acids of the present invention. The most preferred branched acid is iso-oxo octanoic acid, e.g., Cekanoic 8 acid. Although 2-ethylhexanoic acid is an iso-$C_8$ acid and is occasionally referred to as an oxo acid, it is formed via a two step process comprising a hydroformylation reaction followed by an aldol reaction and therefore does not constitute an "oxo acid" as defined by the present invention.

"≠-carbons" as referred to herein shall mean the carbon atom along the carbon chain which nearest the carbonyl carbon. Accordingly, the beta-carbon is the carbon next to the ≠-carbon and higher carbons are those attached to the beta-carbon and beyond.

The term "iso" is meant to convey a multiple isomer product made by the oxo process. Although iso-nonanoic acid is normally considered to be 3,5,5-trimethyl hexanoic acid by one of ordinary skill in the art, for purposes of this case it shall refer to multiple isomer products formed from the oxo processing of iso-octene and shall specifically exclude 3,5,5-trimethyl hexanoic acid.

It is desirable to have a branched oxo acid comprising multiple isomers, preferably more than 3 isomers, most preferably more than 5 isomers.

Branched oxo acids may be produced in the so-called "oxo" process by hydroformylation of commercial branched $C_4$–$C_9$ olefin fractions to a corresponding branched $C_5$–$C_{10}$ aldehyde-containing oxonation product. In the process for forming oxo acids it is desirable to form an aldehyde intermediate from the oxonation product followed by conversion of the crude oxo aldehyde product to an oxo acid. Oxo acids are key reactants for the production of biodegradable branched polyol esters according to the present invention.

In order to commercially produce oxo acids, the hydroformylation process is adjusted to maximize oxo aldehyde formation. This can be accomplished by controlling the temperature, pressure, catalyst concentration, and/or reaction time. Thereafter, the demetalled crude aldehyde product is distilled to removed oxo alcohols from the oxo aldehyde which is then oxidized according to the reaction below to produce the desired oxo acid:

$$RCHO+\tfrac{1}{2}O_2 \rightarrow RCOOH \quad (1)$$

where R is a branched alkyl group.

Alternatively, oxo acids can be formed by reacting the demetalled crude aldehyde product with water in the presence of an acid-forming catalyst and in the absence of hydrogen, at a temperature in the range between about 93° to 205° C. and a pressure of between about 0.1 to 6.99 MPa, thereby converting the concentrated aldehyde-rich product to a crude acid product and separating the crude acid product into an acid-rich product and an acid-poor product.

The production of branched oxo acids from the cobalt catalyzed hydroformylation of an olefinic feedstream preferably comprises the following steps:

(a) hydroformylating an olefinic feedstream by reaction with carbon monoxide and hydrogen (i.e., synthesis gas) in the presence of a hydroformylation catalyst under reaction conditions that promote the formation of an aldehyde-rich crude reaction product;

(b) demetalling the aldehyde-rich crude reaction product to recover therefrom the hydroformylation catalyst and a substantially catalyst-free, aldehyde-rich crude reaction product;

(c) separating the catalyst-free, aldehyde-rich crude reaction product into a concentrated aldehyde-rich product and an aldehyde-poor product;

(d) reacting the concentrated aldehyde-rich product either with (i) oxygen (optionally with a catalyst) or (ii) water in the presence of an acid-forming catalyst and in the absence of hydrogen, thereby converting the concentrated aldehyde-rich product into a crude acid product; and (e) separating the crude acid product into a branched oxo acid and an acid-poor product.

The olefinic feedstream is preferably any $C_4$ to $C_9$ olefin, more preferably a branched $C_7$ olefin. Moreover, the olefinic feedstream is preferably a branched olefin, although a linear olefin which is capable of producing all branched oxo acids are also contemplated herein. The hydroformylation and subsequent reaction of the crude hydroformylation product with either (i) oxygen (e.g., air), or (ii) water in the presence of an acid-forming catalyst, is capable of producing branched $C_5$ to $C_{10}$ acids, more preferably branched $C_8$ acid (i.e., Cekanoic 8 acid). Each of the branched oxo $C_5$ to $C_{10}$ acids formed by the conversion of branched oxo aldehydes typically comprises, for example, a mixture of branched oxo acid isomers, e.g., Cekanoic 8 acid comprises a mixture of 26 wt. % 3,5-dimethyl hexanoic acid, 19 wt. % 4,5-dimethyl hexanoic acid, 17 wt. % 3,4-dimethyl hexanoic acid, 11 wt. % 5-methyl heptanoic acid, 5 wt. % 4-methyl heptanoic acid, and 22 wt. % of mixed methyl heptanoic acids and dimethyl hexanoic acids.

Any type of catalyst known to one of ordinary skill in the art which is capable of converting oxo aldehydes to oxo acids is contemplated by the present invention. Preferred acid-forming catalysts are disclosed in co-pending and commonly assigned U.S. patent application Ser. No. 08/269,420 (Vargas et al.), filed on Jun. 30, 1994, and which is incorporated herein by reference. It is preferable if the acid-forming catalyst is a supported metallic or bimetallic catalyst. One such catalyst is a bimetallic nickel-molybdenum catalyst supported on alumina or silica alumina which catalyst has a phosphorous content of about 0.1 wt. % to 1.0 wt. %, based on the total weight of the catalyst. Another catalyst can be prepared by using phosphoric acid as the solvent for the molybdenum salts which are impregnated onto the alumina support. Still other bimetallic, phosphorous-free Ni/Mo catalyst may be used to convert oxo aldehydes to oxo acids.

BIODEGRADABLE LUBRICANTS

The branched synthetic ester base stock can be used in the formulation of biodegradable lubricants together with selected lubricant additives. The additives listed below are typically used in such amounts so as to provide their normal attendant functions. Typical amounts for individual components are also set forth below. The preferred biodegradable lubricant contains approximately 80% or greater by weight of the base stock and 20% by weight of any combination of the following additives:

| | (Broad) Wt. % | (Preferred) Wt. % |
|---|---|---|
| Viscosity Index Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergents and Rust Inhibitors | 0.01–6 | 0.01–3 |
| Pour Point Depressant | 0.01–1.5 | 0.01–1.5 |
| Antifoaming Agents | 0.001–0.1 | 0.001–0.01 |
| Antiwear Agents | 0.001–5 | 0.001–1.5 |
| Seal Swellant | 0.1–8 | 0.1–4 |
| Friction Modifiers | 0.01–3 | 0.01–1.5 |
| Biodegradable Synthetic Ester Base Stock | ≧80% | ≧80% |

When other additives are employed, it may be desirable, although not necessary, to prepare additive concentrates comprising concentrated solutions or dispersions of the dispersant (in concentrated amounts hereinabove described), together with one or more of the other additives (concentrate when constituting an additive mixture being referred to herein as an additive package) whereby several additives can be added simultaneously to the base stock to form the lubricating oil composition. Dissolution of the additive concentrate into the lubricating oil may be facilitated by solvents and by mixing accompanied with mild heating, but this is not essential. The concentrate or additive-package will typically be formulated to contain the dispersant additive and optional additional additives in proper amounts to provide the desired concentration in the final formulation when the additive package is combined with a predetermined amount of base lubricant or base stock. Thus, the biodegradable lubricants according to the present invention can employ typically up to about 20 wt. % of the additive package with the remainder being biodegradable ester base stock and/or a solvent.

All of the weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

Examples of the above additives for use in biodegradable lubricants are set forth in the following documents which are incorporated herein by reference: U.S. Pat. No. 5,306,313 (Emert et al.), which issued on Apr. 26, 1994; U.S. Pat. No.

5,312,554 (Waddoups et al.), which issued on May 17, 1994; U.S. Pat. No. 5,328,624 (Chung), which issued Jul. 12, 1994; an article by Benfaremo and Liu, "Crankcase Engine Oil Additives", *Lubrication*, Texaco Inc., pp. 1–7; and an article by Liston, "Engine Lubricant Additives What They are and How They Function", *Lubrication Engineering*, May 1992, pp. 389–397.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties. Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at temperatures in the range of about 66 to about 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkyl-phenolthioesters having preferably $C_5$ to $C_{12}$ alkyl side chains, e.g., calcium nonylphenol sulfide, barium octylphenylsulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids. Representative examples of suitable friction modifiers are fatty acid esters and amides, molybdenum complexes of polyisobutenyl succinic anhydride-amino alkanols, glycerol esters of dimerized fatty acids, alkane phosphonic acid salts, phosphonate with an oleamide, S-carboxyalkylene hydrocarbyl succinimide, N(hydroxylalkyl)alkenylsuccinamic acids or succinimides, di-(lower alkyl) phosphites and epoxides, and alkylene oxide adduct of phosphosulfurized N(hydroxyalkyl)alkenyl succinimides. The most preferred friction modifiers are succinate esters, or metal salts thereof, of hydrocarbyl substituted succinic acids or anhydrides and thiobisalkanols.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Pour point depressants, otherwise known as lube oil flow improvers, lower the temperature at which the fluid will flow or can be poured. Such additives are well known. Typical of those additives which usually optimize the low temperature fluidity of the fluid are $C_8$ to $C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Antiwear agents, as their name implies, reduce wear of metal parts. Representative of conventional antiwear agents are zinc dialkyldithiophosphate and zinc diaryldithiosphate.

Antifoam agents are used for controlling foam in the lubricant. Foam control can be provided by an antifoamant of the high molecular weight dimethylsiloxanes and polyethers. Some examples of the polysiloxane type antifoamant are silicone oil and polydimethyl siloxane.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (viz. overbased) metal salts, such as highly basic alkaline earth metal sulfonates (especially Ca and Mg salts) are frequently used as detergents.

Seal swellants include mineral oils of the type that provoke swelling of engine seals, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 linkages, e.g., dihexyl phthalate, as are described in U.S. Pat. No. 3,974,081, which is incorporated by reference.

BIODEGRADABLE TWO-CYCLE ENGINE OILS

The branched synthetic ester base stock can be used in the formulation of biodegradable two-cycle engine oils together with selected lubricant additives. The preferred biodegradable two-cycle engine oil is typically formulated using the biodegradable synthetic ester base stock formed according to the present invention together with any conventional two-cycle engine oil additive package. The additives listed below are typically used in such amounts so as to provide their normal attendant functions. The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and antiwear agents.

The biodegradable two-cycle engine oil according to the present invention can employ typically about 75 to 85% base stock, about 1 to 5% solvent, with the remainder comprising an additive package.

Examples of the above additives for use in biodegradable lubricants are set forth in the following documents which are incorporated herein by reference: U.S. Pat. No. 5,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

BIODEGRADABLE CATAPULT OILS

Catapults are instruments used on aircraft carriers at sea to eject the aircraft off of the carrier. The branched synthetic ester base stock can be used in the formulation of biodegradable catapult oils together with selected lubricant additives. The preferred biodegradable catapult oil is typically formulated using the biodegradable synthetic ester base stock formed according to the present invention together with any conventional catapult oil additive package. The additives listed below are typically used in such amounts so as to provide their normal attendant functions. The additive package may include, but is not limited to, viscosity index improvers, corrosion inhibitors, oxidation inhibitors, extreme pressure agents, color stabilizers, detergents and rust inhibitors, antifoaming agents, antiwear agents, and friction modifiers.

The biodegradable catapult oil according to the present invention can employ typically about 90 to 99% base stock, with the remainder comprising an additive package.

Biodegradable catapult oils preferably include conventional corrosion inhibitors and rest inhibitors. If desired, the catapult oils may contain other conventional additives such as antifoam agents, antiwear agents, other antioxidants, extreme pressure agents, friction modifiers and other hydrolytic stabilizers. These additives are disclosed in Klamann, "Lubricants and Related Products", *Verlag Chemie*, Deerfield Beach, Fla., 1984, which is incorporated herein by reference.

BIODEGRADABLE HYDRAULIC FLUIDS

The branched synthetic ester base stock can be used in the formulation of biodegradable hydraulic fluids together with selected lubricant additives. The preferred biodegradable hydraulic fluids are typically formulated using the biodegradable synthetic ester base stock formed according to the present invention together with any conventional hydraulic fluid additive package. The additives listed below are typically used in such amounts so as to provide their normal attendant functions. The additive package may include, but is not limited to, viscosity index improvers, corrosion inhibitors, boundary lubrication agents, demulsifiers, pour point depressants, and antifoaming agents.

The biodegradable hydraulic fluid according to the present invention can employ typically about 90 to 99% base stock, with the remainder comprising an additive package.

Other additives are disclosed in U.S. Pat. No. 4,783,274 (Jokinen et al.), which issued on Nov. 8, 1988, and which is incorporated herein by reference.

BIODEGRADABLE DRILLING FLUIDS

The branched synthetic ester base stock can be used in the formulation of biodegradable drilling fluids together with selected lubricant additives. The preferred biodegradable drilling fluids are typically formulated using the biodegradable synthetic ester base stock formed according to the present invention together with any conventional drilling fluid additive package. The additives listed below are typically used in such amounts so as to provide their normal attendant functions. The additive package may include, but is not limited to, viscosity index improvers, corrosion inhibitors, wetting agents, water loss improving agents, bactericides, and drill bit lubricants.

The biodegradable drilling fluid according to the present invention can employ typically about 60 to 90% base stock and about 5 to 25% solvent, with the remainder comprising an additive package. See U.S. Pat. No. 4,382,002 (Walker et al), which issued on May 3, 1983, and which is incorporated herein by reference.

Suitable hydrocarbon solvents include: mineral oils, particularly those paraffin base oils of good oxidation stability with a boiling range of from 200°–400° C. such as Mentor 28®, sold by Exxon Chemical Americas, Houston, Tex.; diesel and gas oils; and heavy aromatic naphtha.

BIODEGRADABLE WATER TURBINE OILS

The branched synthetic ester base stock can be used in the formulation of biodegradable water turbine oils together with selected lubricant additives. The preferred biodegradable water turbine oil is typically formulated using the biodegradable synthetic ester base stock formed according to the present invention together with any conventional water turbine oil additive package. The additives listed below are typically used in such amounts so as to provide their normal attendant functions. The additive package may include, but is not limited to, viscosity index improvers, corrosion inhibitors, oxidation inhibitors, thickeners, dispersants, anti-emulsifying agents, color stabilizers, detergents and rust inhibitors, and pour point depressants.

The biodegradable water turbine oil according to the present invention can employ typically about 65 to 75% base stock and about 5 to 30% solvent, with the remainder comprising an additive package, typically in the range between about 0.01 to about 5.0 weight percent each, based on the total weight of the composition.

BIODEGRADABLE GREASES

The branched synthetic ester base stock can be used in the formulation of biodegradable greases together with selected lubricant additives. The main ingredient found in greases is the thickening agent or gellant and differences in grease formulations have often involved this ingredient. Besides, the thickener or gellants, other properties and characteristics of greases can be influenced by the particular lubricating base stock and the various additives that can be used.

The preferred biodegradable greases are typically formulated using the biodegradable synthetic ester base stock formed according to the present invention together with any conventional grease additive package. The additives listed below are typically used in such amounts so as to provide their normal attendant functions. The additive package may include, but is not limited to, viscosity index improvers, oxidation inhibitors, extreme pressure agents, detergents and rust inhibitors, pour point depressants, metal deactivators, antiwear agents, and thickeners or gellants.

The biodegradable grease according to the present invention can employ typically about 80 to 95% base stock and about 5 to 20% thickening agent or gellant, with the remainder comprising an additive package.

Typically thickening agents used in grease formulations include the alkali metal soaps, clays, polymers, asbestos, carbon black, silica gels, polyureas and aluminum complexes. Soap thickened greases are the most popular with lithium and calcium soaps being most common. Simple soap greases are formed from the alkali metal salts of long chain fatty acids with lithium 1,2-hydroxystearate, the predominant one formed from 1,2-hydroxystearic acid, lithium hydroxide monohydrate and mineral oil. Complex soap greases are also in common use and comprise metal salts of a mixture of organic acids. One typical complex soap grease found in use today is a complex lithium soap grease prepared from 1,2-hydroxystearic acid, lithium hydroxide monohydrate, azelaic acid and mineral oil. The lithium soaps are described and exemplified in many patents including U.S. Pat. No. 3,758,407 (Harting), which issued on Sep. 11, 1973; U.S. Pat. No. 3,791,973 (Gilani), which issued on Feb. 12, 1974; and U.S. Pat. No. 3,929,651 (Murray), which issued on Dec. 30, 1975, all of which are incorporated herein by reference together with U.S. Pat. No. 4,392,967 (Alexander), which issued on Jul. 12, 1983.

A description of the additives used in greases may be found in Boner, "Modern Lubricating Greases", 1976, Chapter 5, which is incorporated herein by reference, as well as additives listed above in the other biodegradable products.

BIODEGRADABLE COMPRESSOR OILS

The branched synthetic ester base stock can be used in the formulation of biodegradable compressor oils together with selected lubricant additives. The preferred biodegradable compressor oil is typically formulated using the biodegradable synthetic ester base stock formed according to the present invention together with any conventional compressor oil additive package. The additives listed below are typically used in such amounts so as to provide their normal attendant functions. The additive package may include, but is not limited to, oxidation inhibitors, additive solubilizers, rust inhibitors/metal passivators, demulsifying agents, and antiwear agents.

The biodegradable compressor oil according to the present invention can employ typically about 80 to 99% base stock and about 1 to 15% solvent, with the remainder comprising an additive package.

The additives for compressor oils are also set forth in U.S. Pat. No. 5,156,759 (Culpon, Jr.), which issued on Oct. 20, 1992, and which is incorporated herein by reference.

EXAMPLE 1

The following are conventional ester base stocks which do not exhibit satisfactory properties for use as biodegradable lubricants. The properties listed in Tables 1 were determined as follows. Pour Point was determined using ASTM #D-97. Brookfield Viscosity at −25° C. was determined using ASTM #D-2983. Kinematic viscosity (@40 and 100° C.) was determined using ASTM #D-445. Biodegradation was determined using the Modified Sturm test (OECD Test No. 301B). Solubility with dispersant was determined by blending the desired ratios and looking for haze, cloudiness, two-phases, etc. Engine wear was determined using the NMMA Yamaha CE50S Lubricity test.

TABLE 1

| Base stock | Pour Point °C. | Vis @ −25° C. (cPs) | Vis. @ 40° C. (cSt) | Vis. @ 100° C. (cSt) | % Bio. | *Sol with Disp. | Engine Wear |
|---|---|---|---|---|---|---|---|
| Natural Oils | | | | | | | |
| Rapeseed Oil | 0 | Solid | 47.80 | 10.19 | 86.7 | n/a | n/a |
| All Linear Esters | | | | | | | |
| Di-undecyladipate | +21 | solid | 13.92 | 2.80 | n/a | n/a | n/a |
| Polyol w/Linear & Semi-Linear Acids | | | | | | | |
| TPE/C810/C7 acid | n/a | solid | 29.98 | 5.90 | n/a | n/a | n/a |
| TPE/DiPE/n-C7 | −45 | 1380 | 24.70 | 5.12 | 82.31 | H | Fail |
| TPE/C7 acid | −62 | 915 | 24.0 | 4.9 | 83.7 | H | Fail |
| TMP/n-C7,8,10 | −85 | 350 | 17.27 | 4.05 | 61.7** | C | Fail |
| TMP/C7 acid | −71 | 378 | 14.1 | 3.4 | 76.5 | C | Fail |
| Branched Adipates | | | | | | | |
| di-tridecyladipate | −62 | n/a | 26.93 | 5.33 | 65.99 | C | Fail |

*denotes solubility with dispersant: H = haze; C = clear.
**denotes the biodegradation for this material includes 15.5 wt % dispersant.
n/a denotes information was not available.
TPE denotes technical grade pentaerythritol.
TMP denotes trimethylol propane.
C810 denotes predominantly a mixture of n-octanoic and n-decanoic acids, and may include small amounts of n-$C_6$ and n-$C_{12}$ acids. A typical sample of C810 acid may contain, e.g., 3–5% n-$C_6$, 48–58% n-$C_8$, 36–42% n-$C_{10}$, and 0.5–1% n-$C_{12}$.
n-C7,8,10 denotes a blend of linear acids with 7, 8 and 10 carbon atoms, e.g., 37% mole % n-$C_7$ acid, 39 mole % $C_8$ acid, 21 mole % $C_{10}$ acid and 3 mole % $C_6$ acid.
C7 denotes a $C_7$ acid produced by cobalt catalyzed oxo reaction of hexene-1, that is 70% linear and 30% α-branched. The composition includes approximately 70% n-heptanoic acid, 22% 2-methylhexanoic acid, 6.5% 2-ethylpentanoic acid, 1% 4-methylhexanoic acid, and 0.5% 3.3-dimethylpentanoic acid.

Rapeseed oil, a natural product, is very biodegradable, but it has very poor low temperature properties and does not lubricate very well due to its instability. Rapeseed oil is very unstable and breaks down in the engine causing deposit formation, sludge and corrosion problems. The di-undecyladipate, while probably biodegradable, also has very poor low temperature properties. Polyol esters of low molecular weight linear acids do not provide lubricity, and those of high molecular weight linear or semi-linear acids have poor low temperature properties. In addition, the pentaerythritol esters of linear acids are not soluble with polyamide dispersants. The di-tridecyladipate is only marginally biodegradable and, when blended with a dispersant that has low biodegradability, the formulated oil is only about 45% biodegradable. In addition, the di-tridecyladipate does not provide lubricity. Lower molecular weight branched adipates such as di-isodecyladipate, while more biodegradable, also do not provide lubricity and can cause seal swell problems.

EXAMPLE 2

The present inventor conducted a comparative experiment to determine the biodegradability under the Modified Sturm Test for neopentyl glycol and trimethylol propane. The results of are set forth in FIG. 1, attached hereto, wherein neither neopentyl glycol nor trimethylol propane demonstrated any significant degree of biodegradability.

EXAMPLE 3

The present inventor measured the percent biodegradability using the Modified Sturm Test for two branched synthetic polyol esters, i.e., an ester of neopentyl glycol and branched oxo $C_8$ acid (NPG/i-C8), and an ester of trimethylol propane and branched oxo $C_8$ acid (TMP/i-C8). The esters formed by esterifying NPG and TMP with a branched oxo $C_8$ acid exhibited biodegradability under the Modified Sturm Test (i.e., greater than 60% biodegradable within 28 days).

It is highly unexpected that NPG and TMP when esterified with a branched oxo $C_8$ acid would prove to be biodegradable under the Modified Sturm Test even though NPG and TMP by themselves exhibited little or no biodegradability.

EXAMPLE 4

Figure 3:
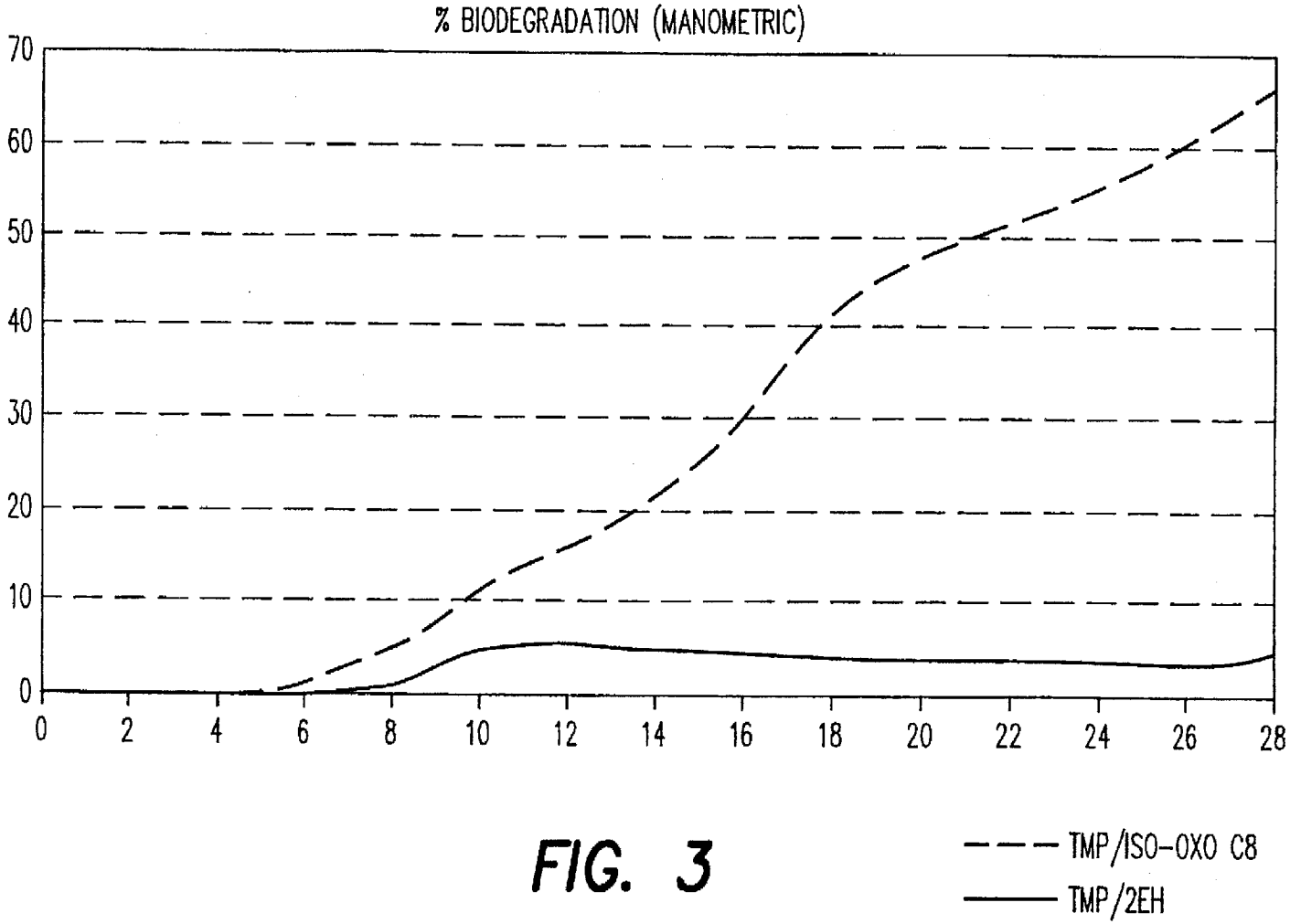
FIG. 3 is a graph plotting percent biodegradation (Modified Sturm Test) versus days in which two synthetic polyol esters formed from a branched oxo $C_8$ acid and 2-ethylhexanoic acid, respectively, are exposed to the environment.

The present inventor also conducted an experiment whose data is set forth in FIG. 3, attached hereto, wherein the ultimate biodegradation of the ester of trimethylol propane reacted with 2-ethylhexanoic acid (i.e., an iso-$C_8$ acid) was 5%; whereas the ultimate biodegradation of the ester of trimethylol propane reacted with a branched oxo $C_8$ acid (i.e., Cekanoic 8) was 67% as measured by the Modified Sturm Test. The present inventor believes that this unexpected result caused the reaction of two seemingly similar iso-$C_8$ acids was due to the unique structural properties of the branched oxo $C_8$ acid. That is, the substantially greater biodegradability exhibited by the TMP/branched oxo $C_8$ acid ester is due primarily to the oxo process used to make this iso-octanoic oxo acid. Using the oxo or hydroformylation process on a feedstream of mixed branched heptenes produces a branched $C_8$ oxo acid whose branching is along the chain in such a way that very little branching is on the ≠-carbon. Because the branching is away from the ester linkages (i.e., on the beta-carbon or higher), enzymatic cleavage of the linkage can occur.

What is claimed is:

1. A biodegradable synthetic ester base stock which comprises the reaction product of:

a branched or linear alcohol selected from the group consisting of: neopentyl glycol, trimethylol propane, ethylene or propylene glycol, butane diol, sorbitol, and 2-methylpropane diol; and at least one branched oxo acid having a carbon number in the range between about $C_5$ to $C_{10}$ and wherein the branching is on the beta-carbon or higher, provided that said branched oxo acid does not include 2-ethylhexanoic acid; wherein said ester base stock exhibits the following properties: at least 60% biodegradation in 28 days as measured by the Modified Sturm test; a pour point of less than −25° C.; and a viscosity of less than 7500 cps at −25° C.

2. The biodegradable synthetic ester base stock according to claim 1 wherein said branched oxo acid is formed from the following steps:

(a) hydroformylating a $C_4$ to $C_9$ olefinic feedstream by reaction with carbon monoxide and hydrogen in the presence of a hydroformylation catalyst under reaction conditions that promote the formation of an aldehyde-rich crude reaction product;

(b) demetalling said aldehyde-rich crude reaction product to recover therefrom said hydroformylation catalyst and a substantially catalyst-free, aldehyde-rich crude reaction product;

(c) separating said catalyst-free, aldehyde-rich crude reaction product into a concentrated aldehyde-rich product and an aldehyde-poor product;

(d) reacting said concentrated aldehyde-rich product either with (i) oxygen or (ii) water in the presence of an acid-forming catalyst and in the absence of hydrogen, thereby converting said concentrated aldehyde-rich product into a crude acid product; and (e) separating said crude acid product into said branched oxo acid and an acid-poor product.

3. The biodegradable synthetic ester base stock according to claim 2 wherein said branched oxo acid is an iso-octanoic acid comprises a mixture of 3,5-dimethyl hexanoic acid, 4,5-dimethyl hexanoic acid, 3,4-dimethyl hexanoic acid, 5-methyl heptanoic acid, 4-methyl heptanoic acid, and mixed methyl heptanoic acids and dimethyl hexanoic acids.

4. The biodegradable synthetic ester base stock according to claim 1 wherein said branched oxo acid has a carbon number in the range between about $C_7$ to $C_{10}$.

5. The biodegradable synthetic ester base stock according to claim 1 wherein said branched oxo acid comprises at least 3 isomers.

6. The biodegradable synthetic ester base stock according to claim 1 wherein said ester also exhibits a high flash point COC of at least 175° C.

7. The biodegradable synthetic ester base stock according to claim 1 wherein said branched oxo acid has an average branching per molecule in the range between about 0.3 to 1.9.

8. The biodegradable synthetic ester base stock according to claim 1 wherein said branched oxo acid is at least one acid selected from the group consisting of: iso-pentanoic acids, iso-hexanoic acids, iso-heptanoic acids, iso-octanoic acids, iso-nonanoic acids, and iso-decanoic acids; provided that said iso-nonanoic is not 3,5,5-trimethylhexanoic acid.

9. The biodegradable synthetic ester base stock according to claim 1 wherein no more than 10% of said branched oxo acids used to form said biodegradable synthetic ester base stock contain a quaternary carbon.

10. A biodegradable lubricant which is prepared from at least one biodegradable synthetic ester base stock which comprises the reaction product of: a branched or linear alcohol selected from the group consisting of: neopentyl glycol, trimethylol propane, ethylene or propylene glycol, butane diol, sorbitol, and 2-methylpropane diol; and at least one branched oxo acid having a carbon number in the range between about $C_5$ to $C_{10}$ and wherein the branching is on the beta-carbon or higher, provided that said branched oxo acid does not include 2-ethylhexanoic acid; wherein said ester base stock exhibits the following properties: at least 60% biodegradation in 28 days as measured by the Modified Sturm test; a pour point of less than −25° C.; and a viscosity of less than 7500 cps at −25° C.; and a lubricant additive package.

11. The biodegradable lubricant according to claim 10 wherein said branched oxo acid is formed from the following steps:

(a) hydroformylating a $C_4$ to $C_9$ olefinic feedstream by reaction with carbon monoxide and hydrogen in the presence of a hydroformylation catalyst under reaction conditions that promote the formation of an aldehyde-rich crude reaction product;

(b) demetalling said aldehyde-rich crude reaction product to recover therefrom said hydroformylation catalyst and a substantially catalyst-free, aldehyde-rich crude reaction product;

(c) separating said catalyst-free, aldehyde-rich crude reaction product into a concentrated aldehyde-rich product and an aldehyde-poor product;

(d) reacting said concentrated aldehyde-rich product either with (i) oxygen or (ii) water in the presence of an acid-forming catalyst and in the absence of hydrogen, thereby converting said concentrated aldehyde-rich product into a crude acid product; and (e) separating said crude acid product into said branched oxo acid and an acid-poor product.

12. The biodegradable lubricant according to claim 10 wherein said branched acid has a carbon number in the range between about $C_7$ to $C_{10}$.

13. The biodegradable lubricant according to claim 10 wherein said branched acid comprises at least 3 isomers.

14. The biodegradable lubricant according to claim 10 wherein said ester base stock also exhibits a high flash point COC of at least 175° C.

15. The biodegradable lubricant according to claim 10 wherein said branched oxo acid has an average branching per molecule in the range between about 0.3 to 1.9.

16. The biodegradable lubricant according to claim 10 wherein said branched oxo acid is at least one acid selected from the group consisting of: iso-pentanoic acids, iso-hexanoic acids, iso-heptanoic acids, iso-octanoic acids, iso-nonanoic acids, and iso-decanoic acids; provided that said iso-nonanoic acid is not 3,5,5-trimethylhexanoic acid.

17. The biodegradable lubricant according to claim 10 wherein said biodegradable lubricant is a blend of said branched synthetic esters and at least one ester selected from the group consisting of: rapeseed oil and other synthetic esters.

18. The biodegradable lubricant according to claim 10 wherein said additive package comprises additives selected from the group consisting of: viscosity index improvers, corrosion inhibitors, oxidation inhibitors, dispersants, lube oil flow improvers, detergents and rust inhibitors, pour point depressants, anti-foaming agents, antiwear agents, seal swellants, and friction modifiers.

19. The biodegradable lubricant according to claim 10 wherein said biodegradable lubricant is a gear oil.

20. The biodegradable lubricant according to claim 10 wherein said biodegradable lubricant is a catapult oil.

21. The biodegradable lubricant according to claim 20 wherein said additive package comprises at least one additive selected from the group consisting of: viscosity index improvers, corrosion inhibitors, oxidation inhibitors, coupling agents, dispersants, extreme pressure agents, color stabilizers, detergents and rust inhibitors, antifoaming agents, antiwear agents, and friction modifiers.

22. The biodegradable lubricant according to claim 10 wherein said biodegradable lubricant is a hydraulic fluid.

23. The biodegradable lubricant according to claim 22 wherein said additive package comprises at least one additive selected from the group consisting of: viscosity index improvers, corrosion inhibitors, boundary lubrication agents, demulsifiers, pour point depressants, and antifoaming agents.

24. The biodegradable lubricant according to claim 10 wherein said biodegradable lubricant is a drilling fluid.

25. The biodegradable lubricant according to claim 24 wherein said additive package comprises at least one additive selected from the group consisting of: viscosity index improvers, corrosion inhibitors, weighting agents, water loss improving agents, bactericides, and drill bit lubricants.

26. The biodegradable lubricant according to claim 10 wherein said biodegradable lubricant is a water turbine oil.

27. The biodegradable lubricant according to claim 26 wherein said additive package comprises at least one additive selected from the group consisting of: viscosity index improvers, corrosion inhibitors, oxidation inhibitors, thickeners, dispersants, anti-emulsifying agents, color stabilizers, detergents and rust inhibitors, and pour point depressants.

28. The biodegradable lubricant according to claim 10 wherein said biodegradable lubricant is a grease.

29. The biodegradable lubricant according to claim 28 wherein said additive package comprises at least one additive selected from the group consisting of: thickening agent, viscosity index improvers, oxidation inhibitors, extreme pressure agents, detergents and rust inhibitors, pour point depressants, metal deactivators, and antiwear agents.

30. The biodegradable lubricant according to claim 10 wherein said biodegradable lubricant is a compressor oil.

31. The biodegradable lubricant according to claim 30 wherein said additive package comprises at least one additive selected from the group consisting of: oxidation inhibitors, detergents and rust inhibitors, metal deactivators, additive solubilizers, demulsifying agents, and antiwear agents.

32. The biodegradable lubricant according to claim 10 wherein no more than 10% of said branched acids used to form said biodegradable synthetic ester base stock contain a quaternary carbon.

33. The biodegradable lubricant according to claim 10 further comprising a solvent.

34. The biodegradable lubricant according to claim 33 wherein said biodegradable synthetic ester base stock is present in an amount of about 50–99% by weight, said lubricant additive package is present in an amount of about 1 to 20% by weight lubricant additive package; and solvent is present in an amount of about 0 to 30%.

35. The biodegradable lubricant according to claim 10 wherein said biodegradable lubricant is a two-cycle engine oil.

36. The biodegradable lubricant according to claim 35 wherein said additive package includes at least one additive selected from the group consisting of: viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and antiwear agents.

* * * * *